United States Patent [19]

Sherman

[11] Patent Number: 4,966,686

[45] Date of Patent: Oct. 30, 1990

[54] FINE METAL RECOVERY APPARATUS

[75] Inventor: Marvin Sherman, Whitehorse, Canada

[73] Assignee: Wilson Creek Placer Ltd., Whitehorse, Canada

[21] Appl. No.: 155,825

[22] Filed: Feb. 16, 1988

[51] Int. Cl.[5] ..... B07B 1/22; B07B 1/46

[52] U.S. Cl. ..... 209/255; 209/270; 209/284; 209/420

[58] Field of Search ..... 209/240, 243, 244, 255, 209/260, 261, 268, 270, 279, 284, 288–291, 420, 421

[56] References Cited

U.S. PATENT DOCUMENTS

| | | | |
|---|---|---|---|
| 253,452 | 2/1882 | Weber | 209/291 |
| 261,653 | 7/1882 | Bayley | 209/290 X |
| 796,780 | 8/1905 | Weaver | 209/291 |
| 801,703 | 10/1905 | Anderson . | |
| 883,974 | 4/1908 | Roughsedge | 209/291 |
| 1,254,410 | 1/1918 | Krenzer | 209/270 X |
| 1,309,754 | 7/1919 | Dovel | 209/270 |
| 1,581,686 | 4/1926 | O'Toole | 209/291 X |
| 1,948,606 | 2/1934 | Weinig . | |
| 1,960,085 | 5/1934 | Goldberg et al. | 209/291 |
| 4,178,238 | 12/1979 | Harris | 209/270 |

FOREIGN PATENT DOCUMENTS

| | | | |
|---|---|---|---|
| 0459817 | 1/1937 | United Kingdom | 209/290 |

*Primary Examiner*—Robert B. Reeves
*Assistant Examiner*—Edward M. Wacyra
*Attorney, Agent, or Firm*—Bull, Housser & Tupper

[57] ABSTRACT

An apparatus and method for obtaining fine metals from gravel. A tiltable, rotatable cylinder has an inlet and an outlet. A mesh is positioned a predetermined distance from the inside diameter of the cylinder and extends around the periphery of the inside circumference. A first recovery ring is located downstream from the inlet and has an inside diameter greater than the inside diameter of the cylinder. An exit extends from the inside diameter to the outer periphery of the first recovery ring.

7 Claims, 3 Drawing Sheets

FINE METAL RECOVERY APPARATUS

INTRODUCTION

This invention relates to a method and apparatus for separating fine materials from gravel and, more particularly, to a method and apparatus for enhancing the recovery of fine gold from a gold bearing gravel.

BACKGROUND OF THE INVENTION

For many years, the standard way of obtaining heavier metals such as gold, silver, copper and iron from a gravel mixture containing such metals was to subject the gravel containing the metals to the scouring action of a sloped sluice box while washing the gravel with water to carry away the clay in the mixture. The use of such a method to obtain the finer particles in the mixture, however, has always had disadvantages. This is so because the quantity of water required to properly separate the clay from the metals is such that it would carry away the finer metallic particles without depositing them in the sluice. If the quantity of water is decreased, the gravel will not be properly conveyed down the sluice and it will simply deposit in the sluice, again without separating the fine metals.

A further technique used for separating the smaller particles has been to deposit the gravel on a mesh and shake the mesh. The smaller particles, of course, will drop through the mesh where they can be collected. Again, however, this technique is unsatisfactory to obtain fine materials because they are usually combined with clay and the clay cannot be separated from the metals without the use of water which, when used, causes the aforementioned difficulties.

SUMMARY OF THE INVENTION

According to one aspect of the invention, there is disclosed an apparatus for the recovery of fine metals comprising a tiltable, rotatable cylinder having an inlet and an outlet, a mesh positioned circumferentially around and separated a predetermined distance from the inside circumference of said cylinder, a first recovery ring located downstream from said inlet having an inside diameter greater than the inside diameter of said cylinder and exit means extending from the inside diameter to the outside periphery of said first recovery ring.

According to a further aspect of the invention, there is disclosed a method for separating fine particles from a conglomerate mixture comprising introducing said mixture and water to the inlet end of a tiltable, rotatable cylinder, subjecting said mixture to the scouring action of a cylindrical mesh positioned within said cylinder, allowing the fine portions of said mixture to drop through said cylindrical mesh and to be conveyed on the inside circumference of said cylinder, recovering said fine portions in a first recovery means downstream from said inlet end of said cylinder and having an inside diameter greater than the inside diameter of said cylinder and allowing said recovered fine particles to be released from said recovery means.

BRIEF DESCRIPTION OF THE DRAWINGS

A specific embodiment of the invention will now be described, by way of example only, with the use of drawings in which.

DESCRIPTION OF THE PREFERRED EMBODIMENT

Figure 1:
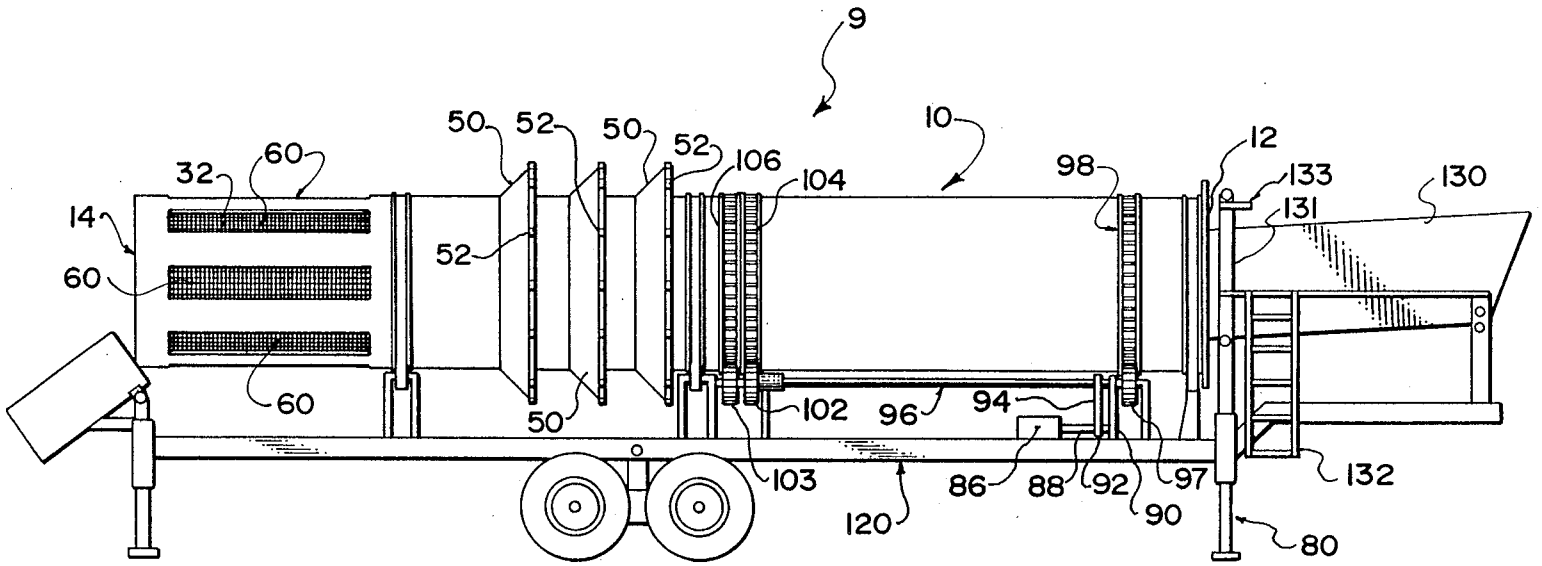
FIG. 1 is a side view of the apparatus according to the invention mounted for operation.
Figure 3:
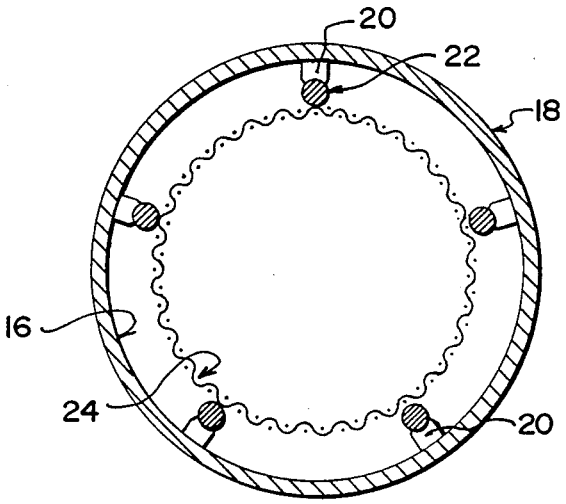
FIG. 3 is a sectional view taken along III-III of FIG. 2A.

Referring now to the drawings, the fine metal recovery apparatus specifically used for gold in the present instance is illustrated generally at 9 in FIG. 1. It includes a tiltable, rotatable cylinder 10 having an inlet end 12, an outlet end 14, an inside circumference 16 and an outside circumference 18 (FIG. 3). A plurality of mounting supports in the form of blocks or spacers 20 are peripherally mounted around and are connected to the inside circumference 16 of the cylinder 10. A plurality of elongated cylindrical rods 22 are also positioned peripherally around the inside of the cylinder 10 on the spacers 20. The rods 22 extend substantially the entire length of the cylinder 10.

A cylindrical mesh 24 also extends substantially the entire length of the cylinder 10 and is mounted on the rods 22 as by, for example, welding. The mesh 24 is positioned a predetermined distance from the inside circumference and extends circumferentially around the inside circumference of the cylinder 10. The mesh 24 has a upper portion 26 near the inlet end 12 of the cylinder 10 and a lower portion 28 near the outlet end 14 of the cylinder 10. The upper portion 26 of the mesh 24 has a first series of apertures (not shown) of uniform size. The lower portion 28 has a second series of apertures 32 also of uniform size as shown best in FIG. 1 with the apertures 32 of the lower portion 28 of the cylinder 10 being larger than the apertures of the upper portion. An aperture size for the upper portion 26 of approximately one-quarter inch has been found satisfactory for most applications.

The cylinder 10 has a plurality of recovery rings 50 extending peripherally around the cylinder 10 and being disposed between the inlet end 12 and the outlet end 14. The recovery rings 50 are a truncated conical shape which communicate with the interior of the cylinder 10. The recovery rings 50 have an inside circumference larger than the inside circumference of the cylinder 10. Each of the recovery rings 50 has a plurality of exits or vents 52 which extend peripherally around the respective recovery ring 50 at the outermost area. The vents 52 have removable caps 53 which allow the vents to be opened or closed as desired.

A plurality of longitudinal openings 60 are equidistantly spaced around the outer circumference 18 of the cylinder 10 adjacent the outlet end 14. The openings 60 are aligned with the apertures 32 in the lower portion of the mesh 24.

Figure 2A:
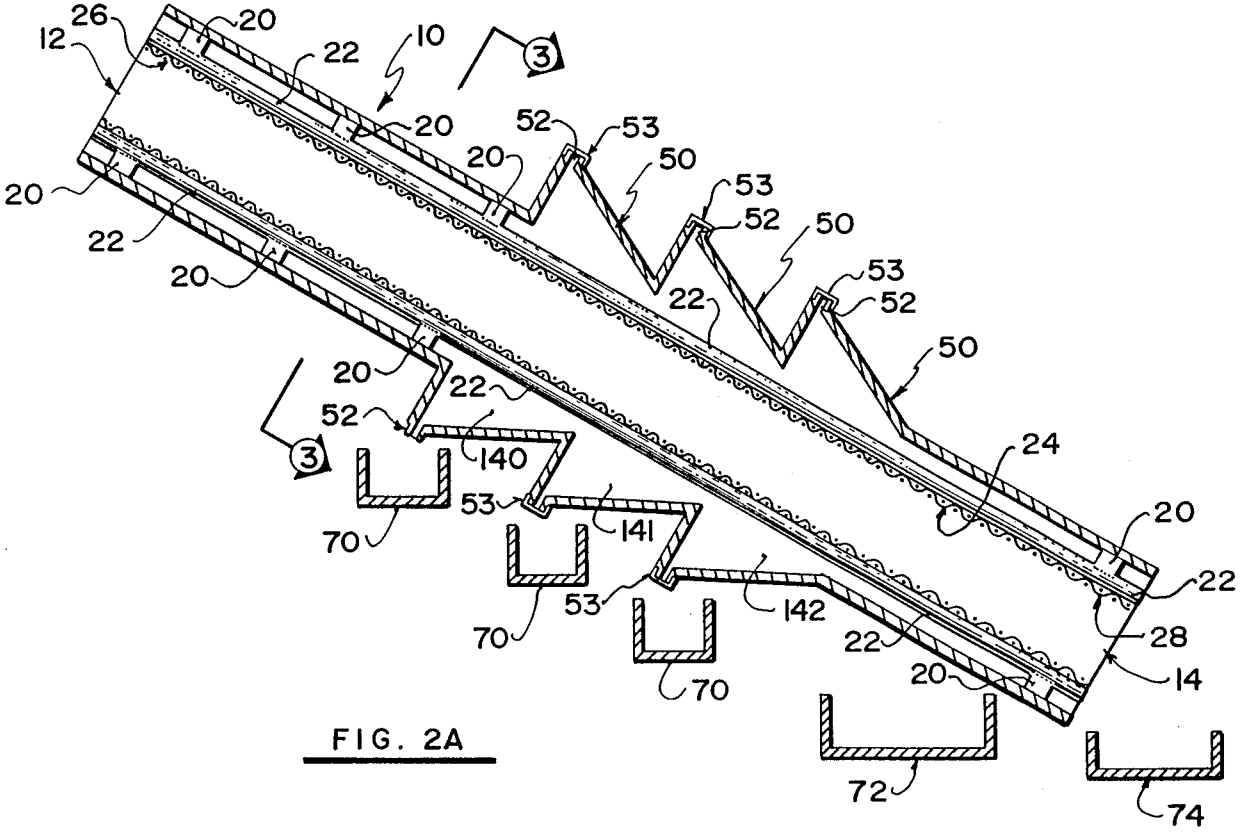
FIG. 2A is a diagrammatic side sectional view of the apparatus of FIG. 1 illustrated, however, in a reversed position.

Referring to FIG. 2A, Respective first sluices or collection trays 70 are positioned below each of the recovery rings 50. In addition, a second sluice or collection tray 72 is positioned below the cylinder 10 and is aligned with the longitudinal openings 60. A third outlet or oversize discharge chute 74 is located adjacent the outlet end 14 of the cylinder 10.

Outrigger 80 are connected adjacent the inlet and outlet ends of the cylinder 10 for lifting the inlet end above the outlet end thereby tilting the cylinder.

A power source in the form of a motor 86 is provided for rotating the cylinder 10. A shaft 88 extends from the motor 86 and is journalled for rotation in a first bracket 90. A gear 92 is connected to the shaft 88 and a chain 94 is driven by gear 92 and, in turn, it drives shaft 96. Shaft 96 is connected to a pinion 97 which drives chain 98. The shaft 96 is also connected to second and third pinions 102 and 103. The pinions drive a second and third chain 104, 106, respectively, which rotate the cylinder 10. A dump box 130 is mounted adjacent the inlet end 12 of the cylinder 10. A water manifold 131 is mounted on the frame 120 near the inlet of the cylinder 10. A ladder 132 is also connected to the frame 120 to provide access to the dump box 130.

OPERATION

In operation, it will initially be assumed there is a small amount of clay in the gravel to be introduced to the inlet end 12 of the cylinder 10. In the event of a small amount of clay, the slope of the cylinder 10 is set between 1½–2 inches per foot of length. In the event the amount of clay is relatively large, the slope will be less and about one inch per foot of length of the cylinder is satisfactory. The operator will load the dump box 130 with gravel into which water from a plurality of nozzles 133 will be sprayed. The operation of the motor 86 will be commenced and the cylinder 10 will be rotated by the action of the various pinion gears 97, 102 and 103 on the drive chains 98, 104, 106. As the gravel moves into the inlet end of the cylinder 10, the fine material falls through the upper portion 26 of the cylindrical mesh 24 with reference to FIGS. 2 and 3. The scouring action of the mesh on the clay and gravel together with the washing action of the water provided from the nozzles 133 will allow the material of a size less than the size of the mesh to drop through the mesh and be carried along the periphery of the cylinder 10 until a first recovery ring 140 is reached. The fine material will gather in the recovery ring 140 until it is full whereupon the excess will continue into a second recovery ring 141 and, thence, into a third recovery ring 142.

The amount of water provided to the gravel in the dump box 130 and thence to the cylinder 10 is, of course, adjustable, for the best scouring action to be obtained on the gravel and, in addition, to properly concentrate and to deposit the fine metals in the recovery rings 140, 141, 142.

Depending on the type of gravel mixture introduced to the cylinder 10 and on the quantity of water being utilized, a predetermined number of exits 52 on the periphery of each recovery ring 140, 141, 142 are opened by removing the caps 53 positioned thereon. As each of the open exits 52 rotates, it will drop below the level of the fine material concentrated in each of the recovery rings 140, 141, 142 and fine material and water will exit from the respective recovery ring into the respective collection tray corresponding to each of the recovery rings 140, 141, 142, respectively. The collection trays or sluices 70, 72 are tilted and, therefore, the water will carry the fine material down the sluice where it is gathered for subsequent processing to remove the desired materials. Material that does not drop through the mesh 24 to be gathered by at least one of the recovery rings 140, 141, 142, will either drop through the mesh 24 in the vicinity of the second series of apertures 32 or, if it remains oversize, will continue through the cylinder 10 until it exits from the outlet end 14 of the cylinder 10 and is released into the oversize discharge chute 74.

In the event the material drops through the second series of apertures 32, it will be gathered by collection tray or sluice 72 and conveyed by the sluice 72 to an accumulation area where, again, the concentrate can subsequently be processed to remove the desired metals. Oversize material exiting the cylinder 10 by way of the oversize discharge chute 74 may be gathered by a further sluice 74 or it may merely exit to the ground or to a discharge bin where it is disposed of or, if it is desired, subject to further processing.

The mesh 24 used within the cylinder 10 is attached to the rods 22 by welding, for example, inside the cylinder 10. The rods 22 are similarly welded to the spacers 20. The spacing between the outside diameter of the mesh 24 and the inside diameter of the cylinder 10 is, of course, adjustable depending on the quality of the gravel introduced to the cylinder 10. It has been found, however, that a value of one inch is typical with the dimension being increased to, say, 1½ inches if there is less clay in the gravel and decreased if there is increased clay present.

While the use of a series of chain drives 98, 104, 106 have been described, various drive mechanisms for the cylinder 10 could be used. For example, a set of rubber drive wheels (not shown) could be located at the area of the chain drives 98, 104, 106 with a set of rubber roller wheels located at support positions. Such wheels would be attractive because of mechanical simplicity, easy replacement and reduced noise.

Similarly, while a set of three recovery rings has been found practicable, the number of rings may be increased or decreased depending on the quality and quantity of the gravel being introduced to the cylinder 10. If there is a large amount of fine material present and the quantity of gravel being introduced to the cylinder 10 is large, an increase in the number of recovery rings would be called for. Likewise, a reduced volume of fine material and a decrease in volume of gravel being introduced would dictate a decrease in the number of recovery rings.

Figure 2B:
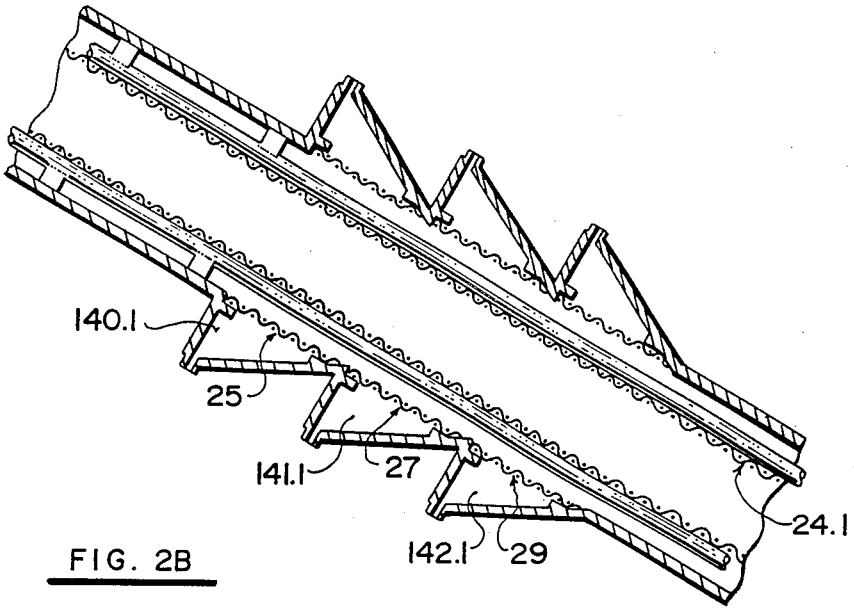
FIG. 2B is a simplified diagrammatic side sectional view of an alternate embodiment of the apparatus of FIG. 1.

For applications in which a heavy metal such as gold is to be recovered, it has been found that the impact of the particular gravel mixture on the quarter inch mesh 24, can create premature wear in the mesh. Referring to FIG. 2*b*, an alternate embodiment of the apparatus has a larger mesh screen, such as a one-half inch mesh screen 24.1 which is capable of withstanding the impact of the gravel mixture used in heavy metal recovery. The mixture is further screened by one-quarter inch annular mesh screens 25, 27 and 29 fastened to the insides of the respective recovery rings 140.1, 141.1 and 142.1. Material less than one-half inch in size is passed through the one-half inch screen 24.1 and material less than one-quarter inch is passed through the one-quarter inch mesh and into the recovery rings 140.1, 141.1 and 142.1, to facilitate heavy metal recovery.

While specific embodiments of the invention have been described, such embodiments should be considered illustrative of the invention only and not as limiting the scope of the invention as construed in accordance with the accompanying claims.

What is claimed is:

1. An apparatus for the recovery of fine metals comprising a tiltable, rotatable cylinder having an inlet and an outlet, a mesh positioned circumferentially around and separated a predetermined distance from the inside circumference of said cylinder, a first recovery ring located downstream from said inlet said first recovery ring comprising a truncated conically shaped annular ring about the circumference of the cylinder having a first side extending outwardly substantially perpendicular of said cylinder merging with a second side angled inwardly toward and merging with said cylinder downstream from said first side, said first recovery ring having an inside diameter greater than the inside diameter of said cylinder, and releasing means extending from the inside diameter of said first recovery ring to the outside periphery of said first recovery ring for releasing the contents of said recovery ring.

2. An apparatus as described in claim 1 where said releasing means comprises a plurality of longitudinal openings.

3. An apparatus as described in claim 2 further comprising a plurality of plugging means for plugging said plurality of openings.

4. An apparatus as described in claim 1 further comprising a second recovery ring, located downstream from said first recovery ring, said second recovery ring comprising a truncated conically shaped annular ring about the circumference of the cylinder having a first side extending outwardly substantially perpendicular of said cylinder merging with a second side angled inwardly toward and merging with said cylinder downstream from said first side, said second recovery ring having an inside diameter greater than the inside diameter of said cylinder.

5. An apparatus as described in claim 4 further comprising a third recovery ring, located downstream of the second recovery ring, said third recovery ring comprising a truncated conically shaped annular ring about the circumference of the cylinder having a first side extending outwardly substantially perpendicular of said cylinder merging with a second side angled inwardly toward and merging with said cylinder downstream from said first side, said third recovery ring having an inside diameter greater than the inside diameter of said cylinder.

6. A method for separating fine particles from a conglomerate mixture comprising the steps of introducing said mixture and water to the inlet end of a tiltable, rotatable cylinder, rotating said cylinder, subjecting said mixture to the scouring action of a cylinder mesh positioned within said cylinder, allowing the fine particles of said mixture and a portion of said water to drop through said cylindrical mesh and to be conveyed on the inside circumference of said cylinder, recovering said fine particles in a first recovery means comprising a truncated conically shaped annular ring about the circumference of the cylinder having a first side extending outwardly substantially perpendicular of said cylinder merging with a second side angled inwardly toward and merging with said cylinder downstream from said first side, said recovery means having an inside diameter greater than the inside diameter of said cylinder and allowing said recovered fine particles to be released from said recovery means.

7. A method as described in claim 6 further comprising the step of: before introducing said mixture and water to the inlet end of said tiltable rotatable cylinder, tilting said tiltable, rotatable cylinder so that the inlet end is higher than the outlet end of said cylinder.

* * * * *